US005421279A

United States Patent [19]

Louks et al.

[11] Patent Number: 5,421,279

[45] Date of Patent: Jun. 6, 1995

[54] METHOD AND APPARATUS FOR CONTROLLING A BOAT DURING PLANING AND TROLLING

[76] Inventors: Robert A. Louks, 2739 310th St., Gilman, Iowa 50106; Gordon D. Louks, 209 Wilson, Laurel, Iowa 50141

[21] Appl. No.: 284,364

[22] Filed: Aug. 2, 1994

[51] Int. Cl.[6] ..... B63H 25/48

[52] U.S. Cl. ..... 114/145 A

[58] Field of Search ..... 114/145 R, 145 A, 285

[56] References Cited

U.S. PATENT DOCUMENTS 2,050,336 8/1936 Karasinski ..... 114/145 A 2,719,503 10/1955 Smith ..... 114/145 A 3,965,838 6/1976 Uht ..... 114/145 A

*Primary Examiner*—Jesus D. Sotelo

*Attorney, Agent, or Firm*—Zarley, McKee, Thomte, Voorhees & Sease

[57] ABSTRACT

A planing and trolling device for use with a boat includes a mounting frame adapted to be attached to the boat. A deflector plate is pivotally mounted to the mounting frame and is pivotal downwardly to a deflecting position facing the rear of the boat propeller. A spring engages the deflector plate and yieldably permits movement of the deflector plate to a horizontal position as the rotational velocity of the propeller increases.

6 Claims, 2 Drawing Sheets

METHOD AND APPARATUS FOR CONTROLLING A BOAT DURING PLANING AND TROLLING

BACKGROUND OF THE INVENTION

The present invention relates to a method and apparatus for controlling a boat during planing and trolling.

Many larger recreational boats are unsuitable for trolling while fishing. The larger boats which have larger motors and propellers move too fast through the water while at idle speed, and therefore are not suitable for trolling.

Deflector plates have been utilized for slowing the speed of the boat so as to enable trolling. These deflector plates are fixedly mounted in facing relationship to the rear of the propeller so as to reduce the velocity of the boat while the propeller is operating at low speeds.

One disadvantage of presently known plates however, is that the plates must be removed manually or moved manually away from the propeller when it is desired to operate the boat at higher speeds.

Therefore a primary object of the present invention is the provision of an improved method and apparatus for controlling a boat during planing and trolling.

A further object of the present invention is the provision of an apparatus for controlling a boat which neutralizes the effect of the propeller torque on the boat, both during slow trolling speeds and during higher planing speeds of the boat.

A further object of the present invention is the provision of an improved apparatus for controlling a boat which begins moving to a planing position automatically whenever the velocity of the boat is increased above a predetermined velocity.

A further object of the present invention is the provision of an improved apparatus for controlling a boat during trolling which will reduce the velocity of the boat down to 0.3 mph.

A further object of the present invention is the provision of a method and apparatus for controlling a boat which facilitates the planing action of the boat during higher speeds.

A further object of the present invention is the provision of an improved apparatus for controlling a boat which reduces side slip of the boat during turning when the device is in its planing position.

A further object of the present invention is the provision of an improved apparatus for controlling a boat which reduces cavitation.

A further object of the present invention is the provision of an improved apparatus for controlling a boat which reduces the velocity of the boat when moving in its forward position, and which permits the boat to be moved in a reverse direction also.

A further object of the present invention is the provision of an improved apparatus which is economical to manufacture, durable in use and simple in construction.

SUMMARY OF THE INVENTION

The foregoing objects are achieved by a planing and controlling device which is adapted to be used with a boat having a bow and a stern and a propeller mounted to the boat. The propeller is adapted to rotate about a propeller axis in a forward drive direction which causes the boat to move in a forward direction, and the propeller can be reversed to a reverse drive direction for causing the boat to move in a rearward direction.

The planing and controlling device includes a mounting frame and a deflector plate having a top edge, a bottom edge, a front face and a rear face.

A hinge mounts the deflector plate to the mounting frame for pivotal movement about a hinge axis between a deflecting position and a planing position. A spring yieldably urges the deflector toward the deflecting position. Securing means are provided for attaching the mounting frame to the boat in a position wherein the deflector plate is positioned adjacent and rearwardly of the propeller with the front face of the deflector plate facing the propeller and with the hinge axis being horizontally disposed above and perpendicular to the propeller axis. The deflector plate is yieldably movable against the spring from its deflecting position toward its planing position in response to the propeller being rotated at a velocity exceeding a predetermined minimum velocity in the forward drive direction to move the boat through the water in the forward direction.

The use of the apparatus of the present invention permits the deflector to slow the velocity of the vehicle at low speeds as would be the case during trolling. It permits the deflector plate to yieldably move upwardly to its horizontal planing position as the velocity of the propeller and the boat are increased. At high speeds the deflector plate is in a horizontal position and facilitates the planing action of the boat. In this position it also reduces cavitation, prevents side slip of the boat during turning, and neutralizes the effect of the propeller torque on the boat.

DETAILED DESCRIPTION OF THE PREFERRED EMBODIMENT

Figure 1:
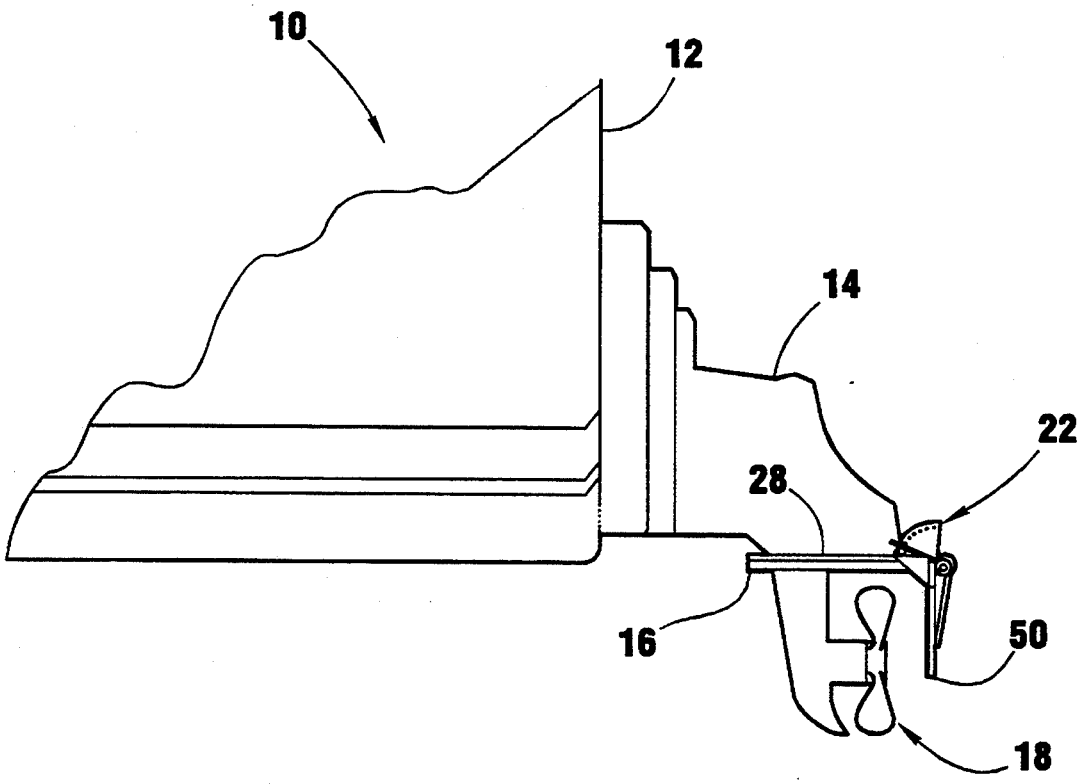
FIG. 1 is a partial view of the rear of a boat showing the propeller and the control device of the present invention.

Referring to the drawings the numeral 10 generally designates a boat having a transom 12 at its stern. Extending rearwardly from the transom 12 is an out drive 14 which includes a horizontal flange 16 and which includes a propeller 18 rotatably driven at the lower end thereof. Propeller 18 includes a plurality of radially extending blades 80 extending radially outwardly from a hub 82. The propeller 18 is rotatably driven about a propeller axis 20 and is reversible so as to drive the boat in a forward direction and also to drive the boat in a rearward direction. While an inboard/outdrive system is shown for boat 10, the present invention is equally applicable to an outboard motor drive system as well as an inboard drive system.

A control device 22 is mounted to the horizontal flange 16 of the outdrive 14. Control device 22 includes a mounting frame 24 and a deflector plate 26. Mounting frame or plate 24 includes two triangular wing plates 28, 30 which are separated by a slot 32. At the outer tips of the wing plates 28, 30 are two downwardly projecting vertical gusset plates 34 each of which have a rearwardly presented vertical edge 36. Fixed to the upper surface of the mounting frame 24 by welding or otherwise is an arcuate adjustment plate 38 having a plurality of adjustment holes 40 arranged in a arcuate array along its upper arcuate edge. Each of the wing plates 28, 30 include a plurality of mounting holes 42 which extend along the edges of the slot 32.

The mounting frame or plate 24 is mounted to the drive 14 by placing the wing plates 28, 30 on opposite sides of the outdrive 14 and in facing engagement with the horizontal flange 16 extending around the outdrive 14. Bolts 43 are used to attach the mounting plate 24 to the horizontal flange 16 as shown in FIG. 2.

Deflector plate 26 includes a front face 44, a rear face 46, a top edge 48, a bottom edge 50, and two opposite side edges 52, 54. Attached to the top edge 48 of deflector plate 26 are a pair of hinged sleeves 56, and attached to the rear edge of mounting frame 24 are a pair of hinged sleeves 58. Extending through hinge sleeves 56, 58 is a hinge pin 60 which provides pivotal mounting of the deflector plate 26 to the mounting plate 24.

Figure 2:
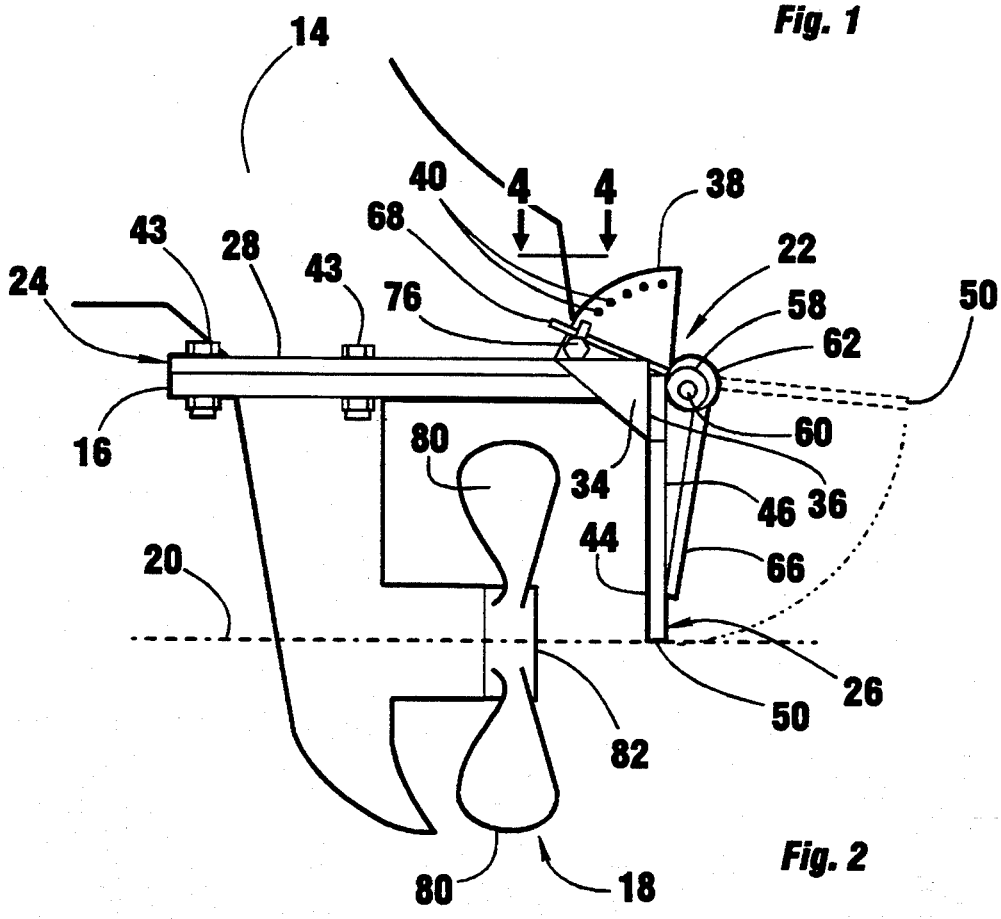
FIG. 2 is an enlarged detail view of FIG. 1.
Figure 3:
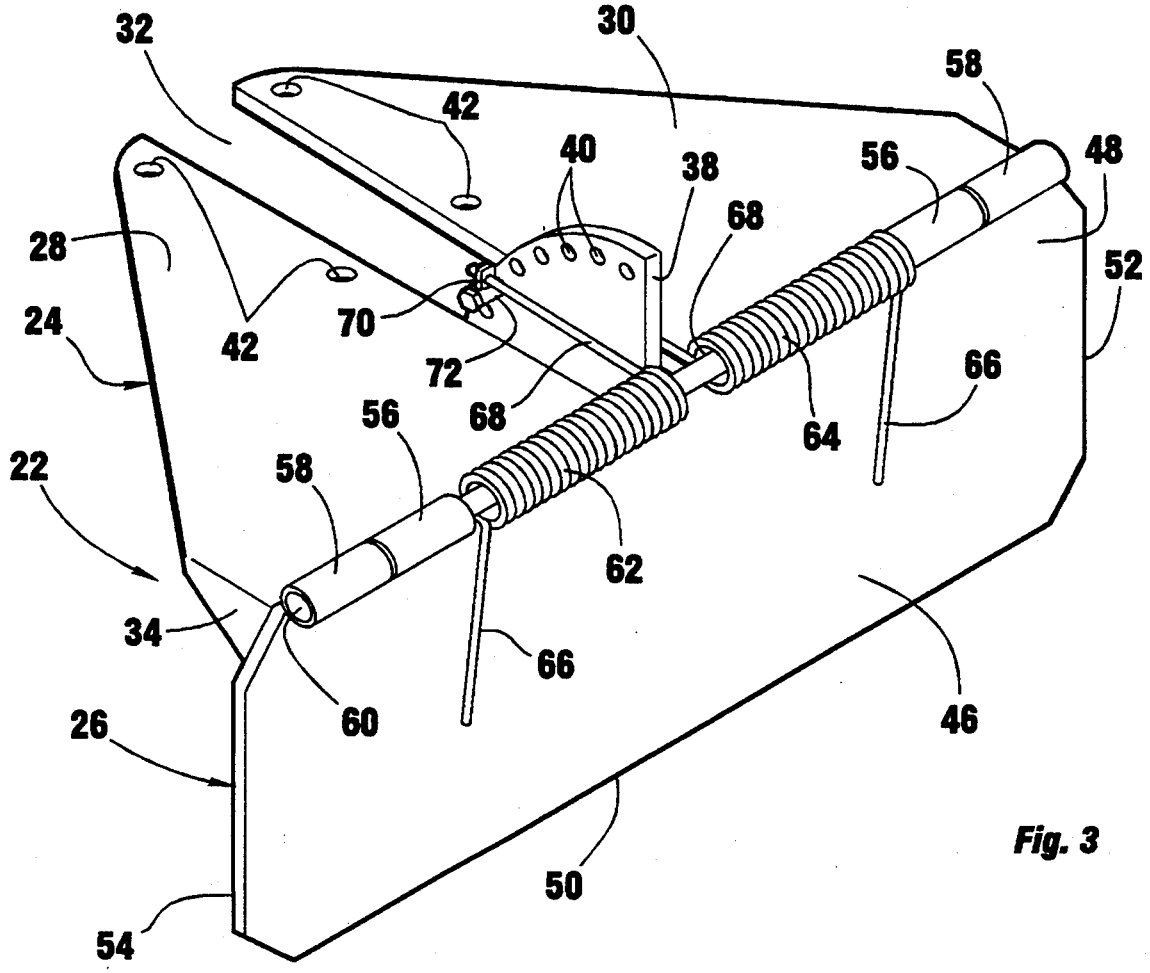
FIG. 3 is a pictorial view of the control device of the present invention.
Figure 4:
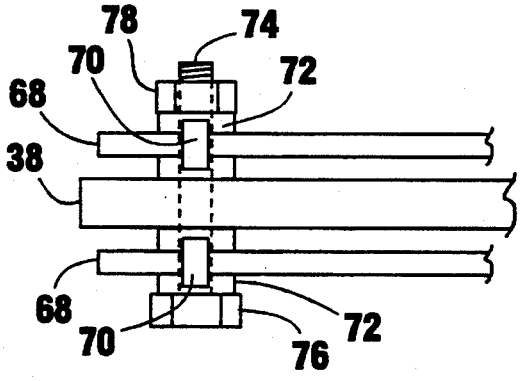
FIG. 4 is an enlarged plan view taken along line 4—4 of FIG. 2.

As seen in FIG. 2, the deflector plate 26 is pivotal about the hinge pin 60 from a deflecting position shown in solid lines to a planing position shown in shadow lines. When in its deflecting position, the front face 44 of the deflector plate 26 faces the rear of the propeller 18. Preferably the bottom edge 50 of the deflector plate 26 is located slightly above the bottom edge of the propeller 18 so that a portion of the propeller 18 is above the bottom edge 50 of the deflector plate and a lower portion of the propeller 18 is below the bottom edge of deflector plate 50. It is preferred that the bottom edge of the deflector plate 50 be in the vicinity of the rotational axis 20 of the propeller 18. In this position the deflector plate permits the propeller to be operated in its reverse direction so as to permit the movement of the boat in a rearward direction. If the deflector plate extends too far below the axis 20 it hinders the rearward movement of the boat 10 when the propeller is reversed.

A pair of torsion springs 62, 64 are mounted around hinge pin 60 and each include first and second spring ends 66, 68. Spring ends 66 bear against the rear face 46 of the deflector plate 26, and the spring ends 68 extend through a grommet 70 which forms a part of a bushing 72. The two bushings 72 are interconnected by a bolt 74 having a bolt head 76. Bolt 74 extends through the two bushings 72 and through one of the adjustment holes 40 in adjustment plate 38. The bolt 74 is held in place by a nut 78 secured on the end thereof.

Torsion springs 62, 64 cause the deflector plate 26 to be yieldably held in its deflecting position shown in solid lines in FIG. 2. The force with which the torsion springs 62, 64 hold the deflector plate 26 in this position may be adjusted by moving the bolt 74 to each of the various holes 40 as desired.

The relative size and shape of the deflector plate 26 may vary depending upon the particular size of propeller and the horsepower of the boat motor. One example would be a plate having a length of 28 inches and a height of 8 inches. Such a plate could be used with a boat having a 60 horsepower up to a 200 horsepower motor with a 12½ inch to a 15 inch propeller diameter from the tip to tip of the propeller blades 80. If the force exerted on deflector plate 26 by torsion springs 62, 64 is set to be between 76 to 94 pounds of pressure, it has been found that the plate moves to its horizontal planing position when the rpms of the propeller are at approximately 1200 rpms. It has also be found that when trolling at idle speeds, the velocity of the boat can be reduced to approximately 0.3 mph.

The rearwardly facing vertical edges 36 of gusset plates 34 engage the deflector plate to limit the movement of the deflector plate past its vertical deflector position when urged to that position by the springs 62, 64. While springs 62, 64 are shown to be torsion springs, other springs mechanisms could easily be adapted for use to urge the deflector plate to its deflector position without detracting from the invention.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing form the spirit or scope of the invention as further defined in the following claims.

What is claimed is:

1. A planing and trolling device for use with a boat having a bow and a stern, a propeller mounted to said boat for rotation about a propeller axis in a forward drive direction which causes said boat to move in a forward direction, said propeller being rotatable about said propeller axis in a reverse drive direction which causes said boat to move in a rearward direction, said planing and trolling device comprising:

a mounting frame;

a deflector plate having a top edge, a bottom edge, a front face, and a rear face;

a hinge mounting said deflector plate to said mounting frame for pivotal movement about a hinge axis between a deflecting position and a planing position;

said deflector plate being approximately a horizontal plane when in said planing position and being in approximately a vertical plane when in said deflecting position;

a spring means yieldably urging said deflector toward said deflecting position;

securing means for attaching said mounting frame to said boat in a position wherein said deflector plate is positioned adjacent and rearwardly of said propeller with said front face of said deflector plate facing said propeller and with said hinge axis being horizontally disposed above and perpendicular to said propeller axis;

said deflector plate being yieldably movable against said spring from said deflecting position toward said planing position in response to said propeller being rotated at a velocity exceeding a predetermined minimum velocity in said forward drive direction to move said boat through said water in said forward direction; and said bottom edge of said deflector plate being positioned relative to said propeller axis so that at least an upper portion of said propeller being defined above said propeller axis lies above said bottom edge of said deflector plate and a lower portion of said propeller being defined below said propeller axis lies wholly below said bottom edge of said deflector plate when said deflector plate is in said deflecting position.

2. A device according to claim 1 wherein said spring means comprises a pair of torsional springs having longitudinal axes coaxial with said hinge axis, said spring means being adjustable so as to permit the adjustment of the force with which said spring yieldably urges said deflector plate to said deflecting position.

3. A device according to claim 2 wherein said adjustable spring means further comprises an upwardly projecting adjustment plate secured to a laterally centralized portion of said mounting frame, said adjustment plate having an arcuately spaced series of holes therethrough for receiving an engagement pin for holding an end of each of said torsional springs against rotation in at least one direction.

4. A method for controlling the planing and trolling of a boat having a bow and a stern and having a propeller adapted to rotate about a propeller axis in a forward drive direction to move said boat forwardly in water and in a reverse drive direction to move said boat rearwardly in said water, said method comprising:

taking a deflector plate having a front face, a top edge, and a bottom edge;

positioning said deflector plate in a deflecting position with said front face thereof facing toward said propeller adjacent and rearwardly of said propeller;

yieldably moving said deflector plate toward a planing position in response to increasing the rotational speed of said propeller in said forward drive direction above said predetermined rotational speed, said front face of said deflector plate being positioned approximately horizontally and above said propeller when said deflector plate is in said planing position;

rotating said deflector plate about a horizontal axis located above said propeller when moving said deflector plate from said deflector position toward said planing position; and keeping said bottom edge of said deflector plate above a lower portion of said propeller being defined below said propeller axis and below a top portion of said propeller defined above said propeller axis when said deflector plate is in said deflector position.

5. A method according to claim 4 and further comprising using an adjustable torsional spring to provide a yieldable force resisting movement of said deflector plate from said deflector position to said planing position.

6. A method according to claim 5 and further comprising adjusting said predetermined rotational speed of said propeller at which said deflector plate begins moving toward said planing position by adjusting said yieldable force provided by said spring.

* * * * *